United States Patent [19]

Kammeraad

[11] Patent Number: 4,493,987

[45] Date of Patent: Jan. 15, 1985

[54] COUNTER

[75] Inventor: James A. Kammeraad, Holland, Mich.

[73] Assignee: K-Line Industries, Inc., Holland, Mich.

[21] Appl. No.: 462,612

[22] Filed: Jan. 31, 1983

[51] Int. Cl.[3] ..... G06C 5/02
[52] U.S. Cl. ..... 235/1 D; 235/96
[58] Field of Search ..... 235/10, 95 R, 96

[56] References Cited

U.S. PATENT DOCUMENTS

| | | | |
|---|---|---|---|
| 618,636 | 1/1899 | Bassett | 235/95 R |
| 1,044,710 | 11/1912 | Veeder | 235/95 R |
| 2,541,161 | 2/1951 | Harper | 235/1 D |

*Primary Examiner*—John Gonzales
*Assistant Examiner*—Brian W. Brown
*Attorney, Agent, or Firm*—Price, Heneveld, Huizenga & Cooper

[57] ABSTRACT

A counter including a housing which is made from a continuous plastic extrusion. End caps which rotatably support the counter barrel shaft fit telescopically within the housing extremities. The extrusion includes detail for mounting a pane in the viewing window.

1 Claim, 3 Drawing Figures

COUNTER

BACKGROUND OF THE INVENTION

This invention relates to counters and, more particularly, to a novel housing for the same.

It is often desirable to maintain a running tally of a sequence of events such as pulley rotations, cable payout length and the like. It is customary, for example, to provide a counter on a fishing downrigger which will indicate to the fisherman at any instance the depth of his downrigger weight.

Counter barrel assemblies of the general type have been available for many years. They are generally housed in metallic or combination metallic-plastic housings. These housings, typically, are made in expensive molds, the resultant product possessing no ability to accommodate differing models or sizes of counting mechanisms.

SUMMARY OF THE INVENTION

The present invention comprises a counter having an extruded housing, the housing having a central bore therethrough within which the counter barrel is positioned and a window in the wall thereof through which the digits on the barrel may be viewed. The housing extrusion may be run, for example, in twenty-foot lengths and individual sections of a predetermined length thereafter cut away to form the housing blanks for a particular counter. The barrel is retained in operating position within the housing by a pair of end caps, each of the caps having means thereon for receiving and supporting the opposite ends of the barrel shaft. Means are provided for affixing the caps to the housing. The design allows a wide variety of direct drive revolution and ratchet counters with different capacities to be manufactured from the same inexpensive tooling using a minimum number of components.

DETAILED DESCRIPTION OF THE PREFERRED EMBODIMENT

Figure 1:
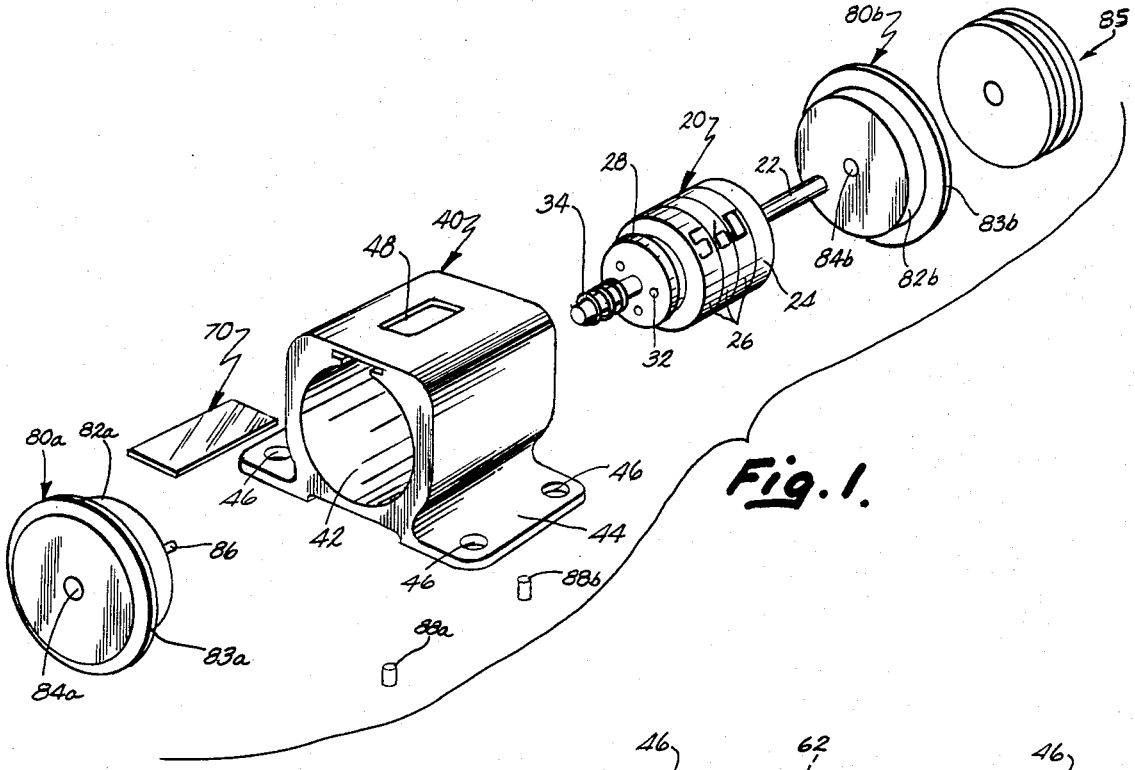
FIG. 1 is an exploded view of a counter fabricated in accordance with the teachings of the present invention.

FIG. 1 illustrates the counter 10 which is the subject of this invention in exploded fashion. It includes a conventional counter barrel assembly 20 having a central shaft 22, a drive ring 24, display rings 26 and an index drum 28. Index drum 28, as will be readily appreciated by those skilled in the art, contains at least one aperture 32 on its face, the purpose of which will become clear hereinafter. A compression spring 34 positions the barrel assembly within the housing such that the display rings 26 will be readily visible through the housing window 48, yet permits some longitudinal movement of the shaft should it be bumped or slightly misaligned.

Figure 2:
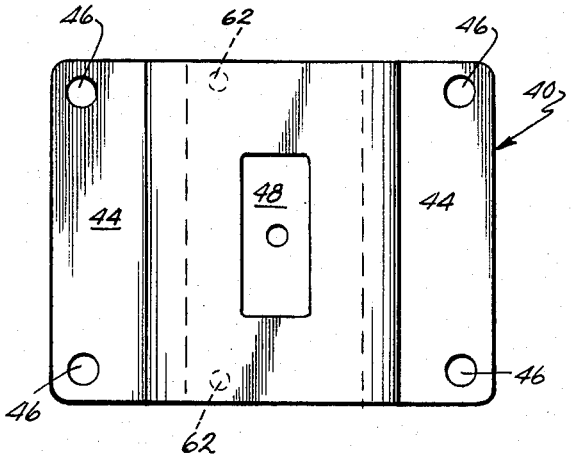
FIG. 2 is a plan view of the counter housing.
Figure 3:
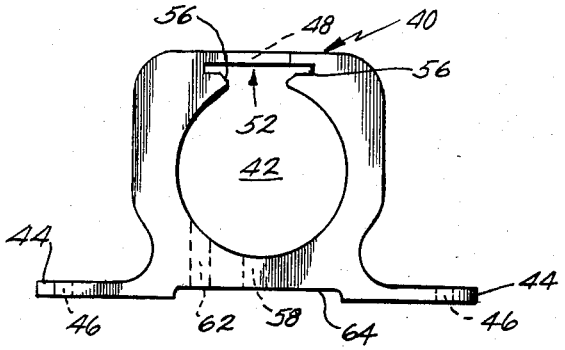
FIG. 3 is a front elevation of the counter housing illustrating, as well, the preferred extrusion form.

Referring now additionally to FIGS. 2 and 3, the counter housing 40 is, as previously noted, manufactured basically by an extrusion process. It may be fabricated from metal such as aluminum, although polyvinyl chloride is the preferred material. The best results have been obtained utilizing as starting material GEON 8700A, manufactured by The B. F. Goodrich Company. Individual counter housings are cut to length from a blank extrusion which may be of any convenient length.

The extruded housing includes a central bore 42 which is bacially circular in cross-sectional configuration. Integrally extruded affixation plates 44 extend from either side of the base thereof and are provided at the four corners with apertures 46 through which screws or other fasteners may pass to affix the housing at the desired location.

The upper surface of the housing is provided with a window 48 dimensioned such that a single row of digits appearing on display rings 26 can be viewed therethrough. Underlying window 48 is a frusto-triangular cutout 52 which provides a flat, rectangular area on the undersurface of the window. The apices of the cutout form slots 56. The frusto-triangular cutout 52 is coextensive in length with the housing 40 and is integrally formed therewith during the extrusion process.

Housing 40 also includes a drain hole 58 and apertures 62. Apertures 62 receive allen screws **88*a* and 88*b* as will be discussed hereinafter. Window 48, affixation apertures 46, drain hole 58 and apertures 62** are formed by any of a number of suitable punching or die cutting techniques either before or after the elongated extrusions are cut into individual housing segments.

End caps **80*a* and 80*b* are formed from any suitable metal or plastic on a screw machine. They are preferably nylon, eliminating the need for separate bearings. They include sections 82*a* and 82*b* which are sized so as to correspond with the effective circular diameter of bore 42 in housing 40. Each also includes an exterior flange section 83*a*, 83*b* and a central bore 84*a*, 84*b*, the bores rotatably accommodating the extremities of shaft 22 on counter barrel assembly 20. The inner face of cap 80*a* has stop pin 86*a* protruding inwardly therefrom. Pin 86*a* is sized so as to be insertable into the prscribed index drum aperture 32**.

Shaft 22 is sized such that it does not protrude from the exterior of cap **84*a* but does protrude exteriorly from cap 80*b*. To this protrusion is affixed a pulley, gear or other actuating mechanism for the counter in conventional fashion, a pulley being shown in FIG. 1 at 85**.

Pane 70, formed from transparent plastic or other suitable transparent material, is slidably received within notches 56 as the initial assembly step. Pane 70, preferably, is equal in length to housing 40 and of a width such that it closely abuts surface 54 after installation to retard admission of water, etc.

Once the pane 70 has been installed, barrel assembly 20 is placed within tubular bore 42 and tubular sections **82*a* and 82*b* of end caps 80*a* and 80*b* telescopically forced into bore 42 until flange sections 83*a* and 83*b* abut the end walls of housing 40. During this procedure, of course, the shaft 22 is fitted into bore 84*a* and passed through bore 84*b* in the end caps. Stop pin 86 is also placed within the suitable indexing aperture 32 and, as will be readily appreciated by those skilled in the art, functions to keep the entire barrel assembly from rotating as shaft 22 is rotated by the actuator 85. Assembly is completed by tightening allen-head screws 88*a* and 88*b* which positively retain the end cap within the housing. This procedure also operates to lock pin 70 into position since either extremity thereof is abutted by the flange sections 83*a* and 83*b* of end caps 80*a*, 80*b*.**

The barrel assembly illustrated in FIG. 1 is of the three-digit type, capable of counting between zero and 999. Should it be desired to increase this capability to between zero and 9,999 through use of a longer barrel assembly containing another display ring 26, it is necessary only to cut the housing blank from the elongated extrusion longer in length than that illustrated. It will also be necessary, of course, to increase the length of window 48 and pane 70. The same extrusion, nevertheless, can be utilized to accommodate counter barrels having virtually an unlimited number of display rings and, thus, counting capability. Assembly is amazingly simple. Extrusion tooling expense is minimal. The resultant counter, more importantly, is extremely rugged in nature and will withstand moderate to severe physical impact far beyond that which state-of-the-art counters can withstand.

While a preferred embodimment of the invention has been described in detail, it will be apparent to those skilled in the art that other embodiments may be conceived and fabricated without departing from the spirit and scope of this invention. Such other embodiments are to be deemed as included within the scope of the appended claims unless, by their language, they expressly state otherwise.

The embodiments of the invention in which an exclusive property or privilege is claimed are defined as follows:

1. A counter comprising:

a counter barrel having a shaft, a plurality of display rings having digits contained thereon, and an index drum having an aperture on its face;

an extruded housing having a base and an upper surface, said housing having a central bore therethrough within which said barrel is positioned and an affixation plate extending from either side of the base thereof for affixing said counter in its working environment;

a drain hole through said base of said housing, said hole being in communication at one end with the central bore and at the other end with the outside environment;

a window in said upper surface of said housing, said window being rectangular in shape and having a length and width substantially smaller than the length and width of said upper surface, the size of said window being dimensioned so as to display therethrough a single row of digits on said display rings;

a frusto-triangular cutout in communication with said central bore and located below said upper surface of said housing, said cutout having a length coextensive with the length of said upper surface, the apices thereof defining a pair of slots, the longitudinal axis of each of said slots being parallel to the longitudinal axis of said upper surface, whereby said slots provide a flat rectangular area below said upper surface and the window located therein;

a transparent pane having a length and width substantially the same as the length and width of said rectangular area defined by said cutout, said pane being inserted into and supported by said slot, said pane thereby being positioned directly below said upper surface of said housing;

a pair of end caps, each of said caps having an interior tubular section matching generally in configuration the configuration of said central bore, said tubular sections being telescopically inserted into said bore during assembly of said counter; an exterior flange section overlying the extremities of said housing when said counter is assembled with said interior tubular sections resting within the extremities of said bore; and means thereon for receiving and supporting opposite ends of the shaft; and a stop pin integrally formed to the inner face of one of said end caps and extending perpendicularly therefrom, said stop pin being inserted into said aperture in said face of said index drum, whereby said stop pin, upon being inserted into said aperture, prevents said counter barrel from rotating as said display rings are rotated.

* * * * *